United States Patent [19]

Hartkorn

[11] 4,091,741

[45] May 30, 1978

[54] SECURITY DEVICE

[75] Inventor: Albert W. Hartkorn, Hershey, Pa.

[73] Assignee: American Multi-Lert Corporation, Hershey, Pa.

[21] Appl. No.: 605,879

[22] Filed: Aug. 19, 1975

[51] Int. Cl.[2] ..... E05B 65/16

[52] U.S. Cl. ..... 105/366 R; 248/119 R; 280/179 R; 292/300; 292/339

[58] Field of Search ..... 105/366 R, 366 A, 366 B, 105/366 C, 366 D, 366 E, 368 R, 368 B, 463, 464, 465; 280/179 R; 248/119 R, 119 S; 292/1, 194, 300, 338, 339, DIG. 15; 220/1.5; 214/65, 515, 621, 654, 750

[56] References Cited

U.S. PATENT DOCUMENTS

| | | | |
|---|---|---|---|
| Re. 19,831 | 1/1936 | Woodruff | 105/366 R |
| 1,675,701 | 7/1928 | Fitch | 105/366 D |
| 1,761,873 | 6/1930 | Clarkson | 220/1.5 |
| 1,856,611 | 5/1932 | Woodruff | 220/1.5 |
| 1,887,707 | 11/1932 | Bates et al. | 220/1.5 |
| 3,193,122 | 7/1965 | Sauthoff | 105/366 R X |
| 3,429,281 | 2/1969 | Gutridge | 105/366 D |
| 3,854,423 | 12/1974 | Bridge | 105/366 D X |

FOREIGN PATENT DOCUMENTS

| | | | |
|---|---|---|---|
| 2,411,780 | 9/1974 | Germany | 214/515 |

*Primary Examiner*—Drayton E. Hoffman
*Assistant Examiner*—Randolph A. Reese
*Attorney, Agent, or Firm*—Burns, Doane, Swecker & Mathis

[57] ABSTRACT

A security device adapted to be applied to retain in closed relation container doors for lading against access into the container. The security device has a shelf portion with an upright arm secured thereto and adapted to be disposed in the path of opening movement of one or both of the container doors to prevent opening movement of the doors sufficiently to gain access to the lading in the container. The arm may be a part of an upright angle bar which forms a support for one end portion of the shelf portion while the opposite end of the shelf portion is supported by a rear upright member. The shelf portion is preferably yieldable to accommodate containers supported in different positions with respect to the surface of the transport vehicle. The upright arm may have a laterally extending arm connected therewith whereby the security device will have a retaining device in the path of both doors. Provision is made for discouraging cutting of the upright arm so as to remove it from the path of the door. Such provision may be made by seam welding applied to an angle bar either or both of which would be difficult to cut with a torch or saw.

15 Claims, 12 Drawing Figures

FIG. 1
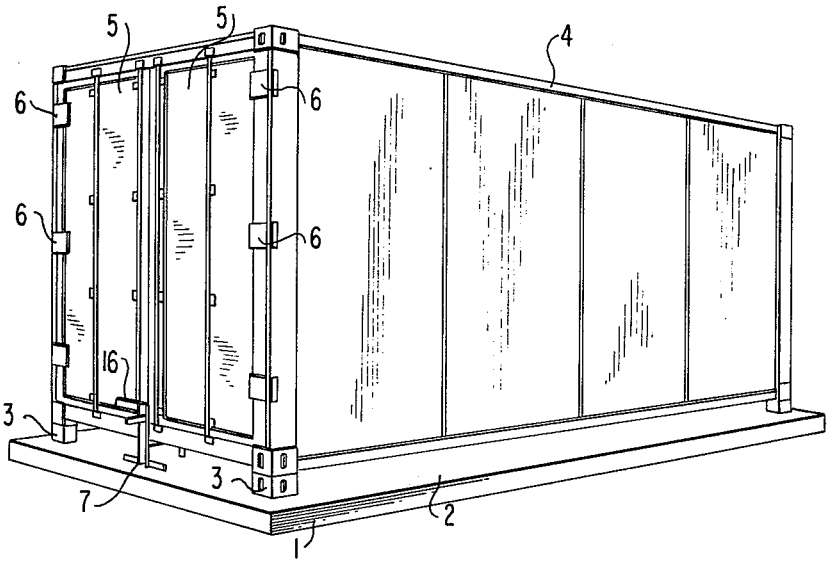
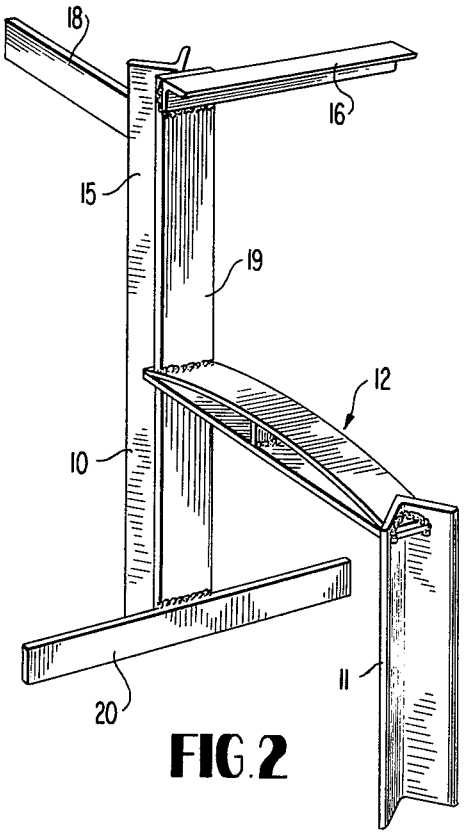
FIG. 2
FIG. 3
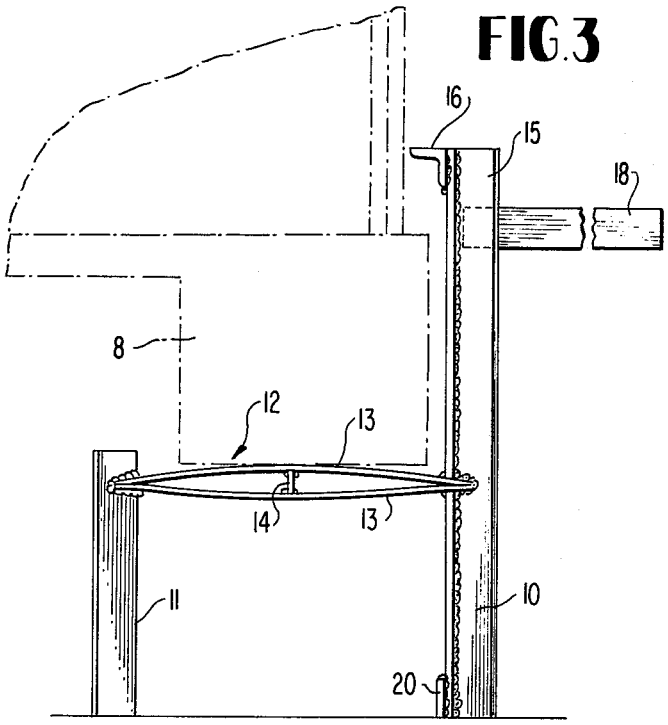
FIG. 13
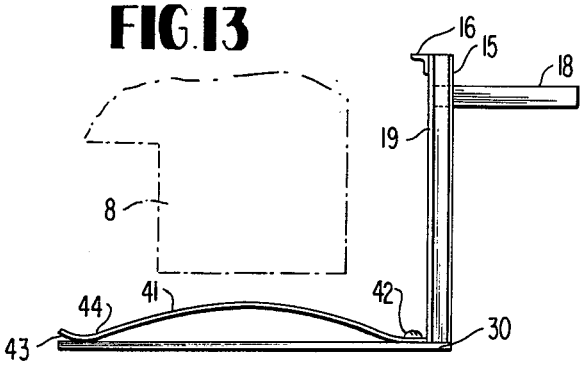
FIG. 4
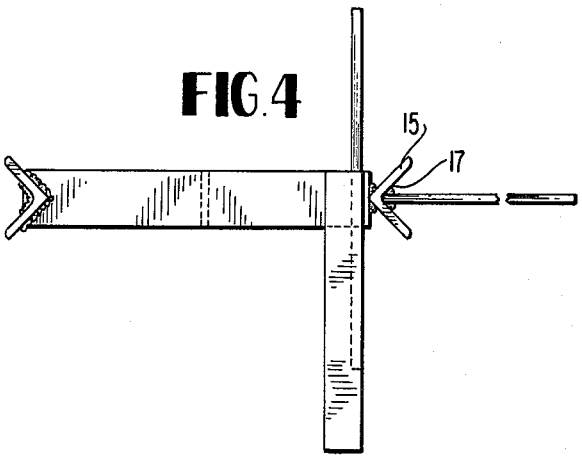

SECURITY DEVICE

SUMMARY OF INVENTION

This invention relates to improvements in security devices adapted for use particularly in connection with transport containers to retain during transit or at a parking area, the swinging doors of the containers against opening sufficiently for access to the lading contained therein.

It is customary at the present time to transport many valuable cargos in containers that are supported upon transport vehicles such as railway flat cars, trailer trucks, ships and the like. The container is set upon the supporting surface of the vehicle and usually secured in place by hooks and chains to maintain its position thereon during transportation. The container is usually provided with a pair of end doors hinged to the body of the container for swinging movement to open and closed positions. The doors usually have overlapped edges and are locked and sealed, but these locks can be broken readily and the seals removed for unlawful entry into the container. Vast quantities of cargo have been stolen from such containers when the transport vehicles are parked at loading or unloading areas or even during transit. No satisfactory means has been found heretofore for preventing effectively the theft and loss of such cargo.

One object of this invention is to provide for the effective surveillance and prevention of theft from a container having one or more swinging doors for access thereto, by utilizing the weight of the container to hold the security device in place.

Another object of the invention is to prevent the opening of a swinging door or doors of a container sufficient for access to the lading therein without lifting the container bodily from its supporting surface.

Another object of the invention is to improve the construction of security devices for a container to enable a security device to be located in position to prevent the opening movement of a swinging door of a container but without physical connection between the security device and the container except as the weight of the container rests upon a portion of the security device to hold it in place.

Still another object of the invention is to improve the construction of security devices for a swinging door of a container so as to provide a shelf portion upon which a part of a container can sit in utilizing the weight of a container to hold the security device in place on the transport vehicle and with an upright arm in the path of opening movement of the swinging door and preferably also having a laterally extended arm which will overlap the adjacent edge of a second door where the two doors are in overlapping relation.

These objects may be accomplished according to certain embodiments of the invention by means of a security device which has a shelf portion with means for supporting the shelf portion on the supporting surface of the transport vehicle in position to have a part of the container seated thereon thereby to hold in place the security device. An arm is connected with the shelf portion extending upright in the path of opening movement of the door to limit the extent of opening movement to less than that which would permit access to the container. A rear member may also be provided if desired connected with the shelf portion and to support the rear end of the shelf portion. The shelf portion is preferably yieldable to accommodate the different heights of support of the container.

BRIEF DESCRIPTION OF DRAWINGS

Certain embodiments of the invention are illustrated in the accompanying drawings in which:

FIG. 1 is a perspective view of a conventional container on a transport vehicle showing the application of the security device thereto;

FIG. 2 is a perspective view of one form of security device embodying this invention;

FIG. 3 is a site elevation thereof;

FIG. 4 is a top plan view thereof;

FIG. 13 is a side elevation of still another form of the invention.

DETAILED DESCRIPTION OF DISCLOSURE

The invention is adapted for use in protecting containers which are in the course of being transported. Many different types of transport vehicles are used for containers, such as railway flat cars, trailer trucks, ships and the like, but also by stacking containers one upon another. I have illustrated merely as an example of these several support vehicles the supporting portion of a transport vehicle designated by the numeral 1 in FIG. 1 and having a surface 2 thereon upon which the container is supported. The container may be set directly upon the supporting surface 2 or be set upon pads or tracks generally indicated at 3 suitably spaced apart to accommodate spaced portions of the container or its sills and to hold the container securely in place on the transport vehicle. Usually the container is secured by suitable hooks and chains (not shown) which will prevent it from being displaced during transit.

A conventional form of container is indicated at 4. There are many different types of containers in service but they are generally of uniform size and ordinarily have a pair of end doors indicated at 5 which may be opened for access to the cargo within the container. Each of the doors is hinged at 6 to the frame of the container and the pair of doors ordinarily have their inner edges in overlapping relation. The pair of doors usually are secured by suitable locks and seals, and when the locks are removed the doors will swing open. Either door can be opened separately after the pair of doors have moved a few inches. A security device is indicated generally at 7 in FIG. 1 and is located in such a position on the support surface 2 that it will prevent the opening of the doors sufficiently for access to the cargo in the container.

Figure 7:
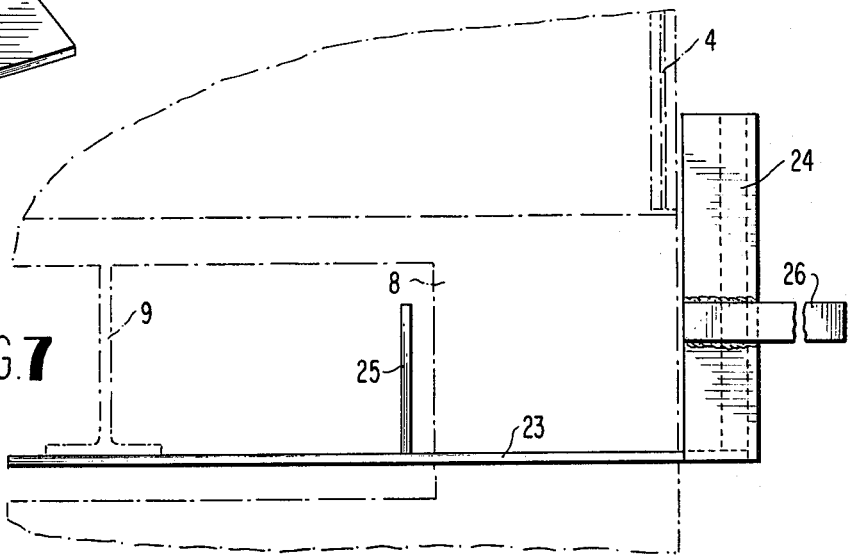
FIG. 7 is a side elevation thereof.
Figure 10:
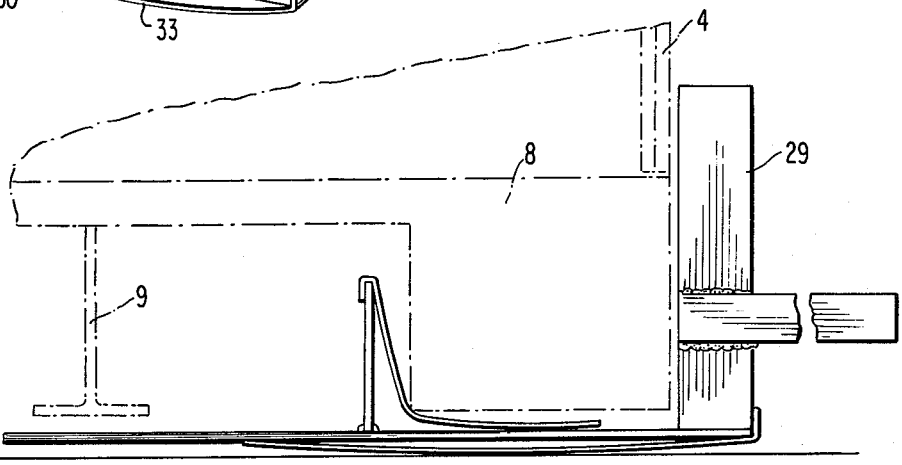
FIG. 10 is a side elevation of the form shown in FIG. 9.

Each container is provided with a support frame structure which is not shown in detail except that the frame structure includes an end sill as illustrated at 8 in FIGS. 3 and 7 and usually the frame structure also includes I-beams indicated at 9 in FIGS. 7 and 10. The supporting frame including the sills usually rests upon the pad supports 3 or upon the supporting surface 2 of the transport vehicle or upon the top of another container where these are piled in superposed relation.

The security device 7 is illustrated in one form in FIGS. 2, 3, and 4. In this form upright front and back supports are shown at 10 and 11 between which extends in bridging relation a shelf portion 12. This shelf portion 12 is composed in this form of a pair of bow springs 13 which are bowed in opposite directions as illustrated in FIG. 3 in order to provide a yieldable and yet strong support for the shelf portion 12. I prefer to have an intermediate rib 14 in the form of a transverse bar interposed between the bow springs 13 and preferably welded or otherwise secured thereto. This rib 14 maintains the bowed relation of the springs.

The front support 10 extends above the shelf portion 12 in the form of an arm 15 that projects above the shelf portion 13 sufficiently to overlap the lower edge portion of the front-most swinging door 5 so as to restrict the opening movement of the door in the event of breakage of the lock. This arm 15 is shown as having a laterally extending arm portion 16 which will overlap the second door edge portion sufficiently so that as the doors are opened enough to release the edge of one from the edge of the other both doors will still be held by the arms 15 and 16 respectively to prevent access to the interior of the container.

Each of the upright supports 10 and 11 and the arm 15 is shown in the form of an angle bar with the apex of the angle facing the adjacent end of the shelf portion 12 as will be apparent from FIG. 2. The parts are secured together by welding and it is also preferable that seam welding seams be provided along the inner side of the angle bar 10-15 as indicated at 17 in FIG. 4.

The angular shape of the bar and the seam welding therein will tend to discourage attempts to sever the bar and remove the arm, either by a hacksaw or a welding torch. Moreover any attempt to cut this arm portion to remove it would cause sparks and noise which would attract attention and thus lead to ready detection.

A handle is shown at 18 secured to one of the diverging sides of the arm 15 for manual grasping to enable a user to position the security device in proper position on the transport surface 2 in preparation for lowering of the container.

The apex of the angle bar 10-15 is also provided with an upright bumper strip of steel or other hard material indicated at 19 preferably extending throughout its length not only to abut against a side face of the sill 8 but to strengthen the angle bar. The lower end of the front support 10 may have a stablizing bar 20 secured thereto, extending transversely of the lower end of the upright bar 19 and secured thereto as by welding. This bar 20 will aid in holding the security device upright during lowering of the container into seated position thereon.

The use of the security device will be apparent from the foregoing explanation and the drawings. The container 4 normally is handled by a crane which raises and lowers the container and sets it down in a supported position upon the transport vehicle. When the lowering means has the container supported over the supporting surface 2 on the transport vehicle or over another container on to which it is to be placed, the workmen will lift the security device 7 into place by means of the handle 18 and set it on the supporting surface or on the under container in such a position with respect thereto that the arm 15 will overlap the lower edge portion of the door 5 which overlaps the second door and near the meeting edges of the doors. As the container 4 is lowered the door end thereof will be brought to rest upon the shelf portion 12 as for example by the sill 8, with sufficient weight of the container thus applied to the shelf portion 12 that the latter will be held securely upon the supporting surface of the transport vehicle or of the container. This will maintain the arm 15 in a holding position. The arm 15 should be located within a few inches of the container door when the latter comes to rest. Even if some opening movement of this door can occur after removal of the locks it will not be enough to allow access to the interior of the container for the removal of cargo. Likewise if the opening movement of the door should be sufficient to release the edge of the second door this will be prevented from full opening by the offset arm portion 16 which overlaps it. Thus both doors are retained in sufficiently closed relation that removal and theft of the cargo is effectively prevented.

If a burglar should attempt to sever and remove the arm portion 15 by means of a hacksaw or torch the noise and sparks resulting therefrom would immediately attract attention and thereby prevent the theft. The angular relation of the sides of the arm 15, as well as the seam welding 17, will deter attempts to cut off this arm in order to gain access to the container.

Various sizes of containers will have a variance of several inches in the supporting frame structure, between the lower edges of the doors and the bottom of the frame supports as well as in the nature of the sill structure thereof. Therefore the yieldable characteristics of the shelf portion 12 will accommodate for these variances in height. It is important that the security device be retained effectively by the weight of the container to prevent it from being removed manually. The initial height of the shelf support 12 should be such as to accommodate these variations in containers and yet retain the security device effectively in place.

Figure 5:
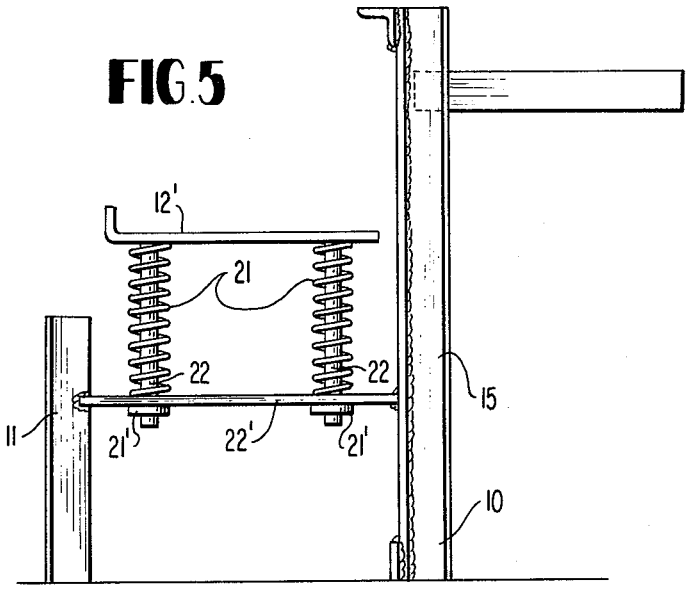
FIG. 5 is a side elevation of a modified form showing a variation in the shelf portion.

In the form of the invention illustrated in FIG. 5, the shelf portion 12′ is supported by coil springs 21 sleeved over steel guiding rods 22. The springs 21 have suitable tension to provide rigid anchoring of the device when the container is lowered onto the shelf 12′. The steel rods 22 guide the upward and downward movement of the shelf 12′ as they move upward and downward through holes in platform 22′. The shelf 12′, springs 21 and rod 22 are prevented from disengagement from platform 22′ by washers 21′ welded to the bottom of the rods 22′. In other aspects this form of the invention acts the same as described above with respect to the form illustrated in FIGS. 2 and 4.

Figure 6:
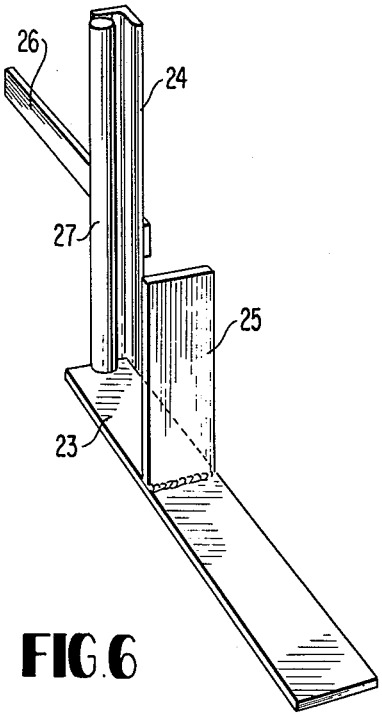
FIG. 6 is a prespective view of another form of security device embodying the invention.

The security device may be set directly upon the supporting surface of the transport vehicle instead of an elevated position upon an elevated support thereon or upon an under container. In that event the security device may have the shelf portion at the bottom of the device as indicated at 23 in FIGS. 6 and 7 with an upright arm 24 at the front end of this shelf portion in a position to extend above the lower edge of the outermost door 5 to retain the latter substantially in closed position. The shelf portion 23 is shown sufficiently lower not only to underlie the sill 8 but also to extend beneath the rib or I-beam 9. An upright member 25 is secured to the shelf portion 23 and extends therefrom in overlapping relation with the sill 8 to retain the security device against being forcibly slid outward from beneath the end portion of the container 4.

In this form, the security device is shown as having an angular bar forming the arm 24 with a handle 26 secured to a side thereof for lifting or moving the security device as described above. A rod 27 also extends along an edge of the bar forming the arm 24 not only to strengthen the latter and aid in the retention of the door but also to prevent the cutting of the arm by added complexities in the cutting action.

Figure 8:
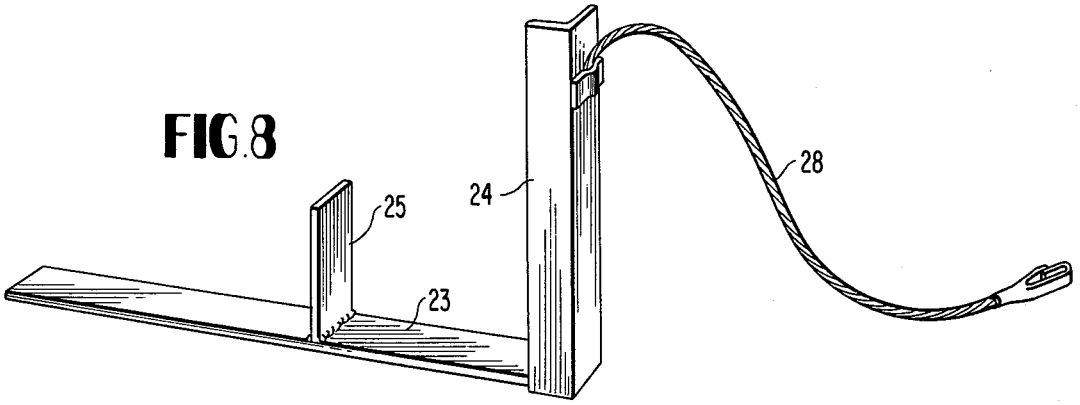
FIG. 8 is a perspective view showing another modified form.

In any of the forms described above I may use a rigid handle as illustrated or a flexible handle member as indicated in FIG. 8 and designated as 28.

Figure 9:
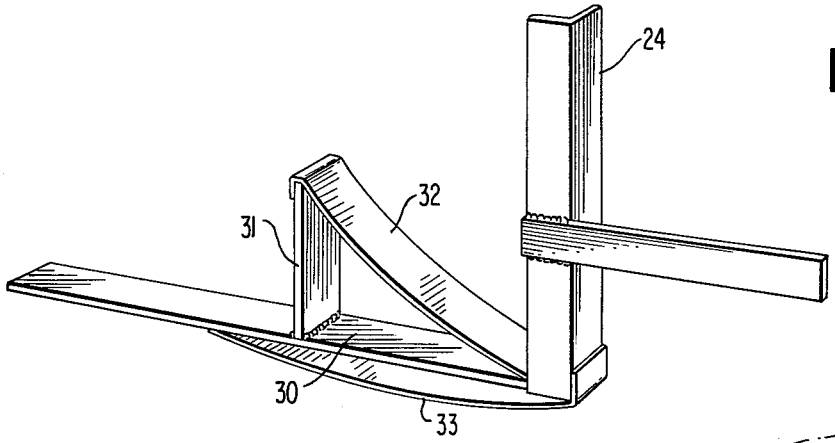
FIG. 9 is a perspective view showing still another modified form.

Still another form of the invention is illustrated in FIGS. 9 and 10 which may be especially practical for use when one container is piled on top of another. This form has an upright front arm 29 extending upward from a bottom support 30 at the forward end of the latter. An upright support 31 is spaced lengthwise of the support 30 a sufficient distance to accommodate the sill 8 or under support of the container. A yieldable shelf portion 32 extends in bridging relation between the support 31 and the lower end of the arm 29. This shelf portion 32 is of yieldable material as to accommodate the weight of the container and to secure the device effectively in place until the container is removed. A bow spring 33 extends lengthwise beneath the portion 30, secured at one end to the lower end of the arm 29, with the other end of the spring 33 bearing upward on the portion 30. This bow spring acts as a yieldable support for the security device upon the supporting surface.

Figure 11:
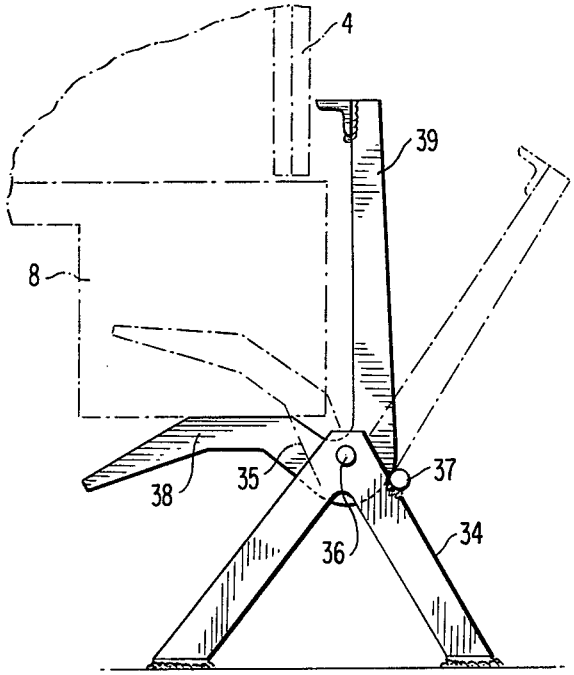
FIG. 11 is a side elevation of yet another modified form of security device.
Figure 12:
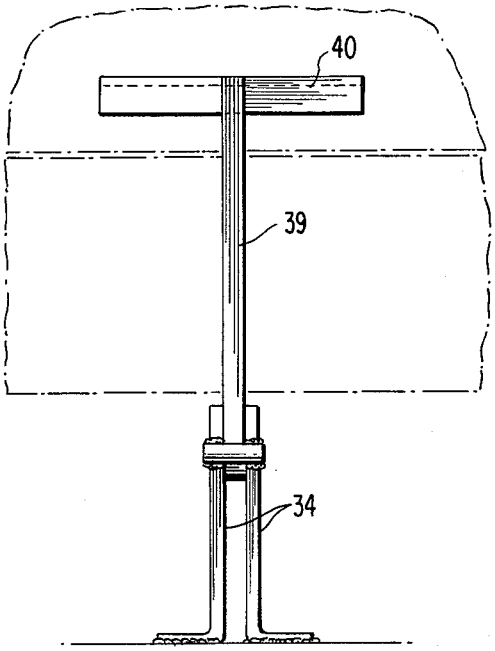
FIG. 12 is a side elevation at right angles to FIG. 11.

The security device shown in FIGS. 11 and 12 may be adapted for use particularly when the container is to be mounted on a flat car or other flat supporting surface. Mounting frames are shown at 34 which may be secured to the supporting surface of the car or other transport vehicle by welding or otherwise. These mounting supports 34 are spaced apart axially and receive therebetween a member 35 mounted on a pivot 36 to swing to different positions as illustrated in full lines and dotted lines in FIG. 11. This swinging movement can be limited as desired by a member 37. One end of the member 35 forms a shelf portion 38 to be engaged by the edge of the container set down while the opposite end forms an arm 39 which extends upright in the path of opening movement of the doors 55. A cross bar 40 on the upper end of the arm 39 may be disposed as to overlap the free edges of both swinging doors and thus prevent them from opening sufficiently to gain access to the cargo in the container.

FIG. 13 shows still another form of the invention which is similar to that shown in FIG. 9, except as herein described. A shell portion 41 of spring steel is attached by a fastening 42 to the platform 30. The spring steel, 41, is bowed such that when the container sill 8 is lowered to compress the spring 41, the curved area at 43 will tend to move upward and inward toward sill 8, riding on the surface of the platform 30, with the area of the spring steel generally indicated at 44 riding freely on platform.

The use of these several modified forms will be apparent from foregoing description and in general will be the same as that described in connection with FIGS. 2 to 4.

While the invention has been illustrated and described in certain embodiments, it is recognized that other variations and changes may be made therein without departing from the invention set forth in the claims.

I claim:

1. The combination with a container having a door at a side thereof mounted for swinging movement to open and closed positions, of a security device including an arm disposed in a retaining position in the path of opening movement of the door from the closed position thereof to prevent substantial opening movement, and means attached to the arm for holding the arm in said retaining position said holding means having at least a portion of the container supported thereon for securing the arm against displacement until the container is moved, wherein the security device comprises a pair of upright rigid supporting members spaced apart, one of which has the arm at the upper end thereof, a plate extending in bridging relation between said upright members beneath the container portion.

2. The combination according to claim 1, wherein the holding means extends under at least a portion of the container and has said container portion seated thereon.

3. The combination according to claim 2, wherein the holding means is resilient and yields to the supported weight of the container portions.

4. A security device for limiting the opening movement of a swinging door of a container seated on a supporting surface, said device comprising a generally horizontal shelf portion adapted to be supported on the surface and to receive a portion of the container seated thereon so that said device is pressurally engaged between the container and the supporting surface, whereby said device is held in position, wherein the shelf portion is yieldable under the weight of the container, upright supporting members attached to the shelf portion for holding the shelf portion in an elevated position above the supporting surface, and an upright arm secured rigidly to the shelf portion in the path of opening movement of the swinging door when the container is seated on the shelf portion.

5. A security device according to claim 4, wherein the arm is angular in cross section and has welding material applied along the corner thereof to prevent severing of the arm.

6. A security device according to claim 4, wherein the shelf portion includes a spring biased member for receiving the container, yieldable under the weight of the container, and the upright supporting members are attached at opposite ends of the shelf portion for holding the shelf portion in elevated position above the supporting surface.

7. The security device of claim 4 wherein said shelf portion and said upright arm are pivotably mounted to said supporting members, whereby said upright arm is pivoted into the path of the opening movement of the swinging door when the container is seated on the shelf portion.

8. A security device for limiting the opening movement of a swinging door of a container seated on a supporting surface, said device comprising front and back upright members adapted to be seated at one end, on the supporting surface, a shelf portion extending in bridging relation between the upright members to receive a portion of the container thereon, the front upright member being angular in cross section with flaring sides directed away from the adjacent end of the shelf portion, the upper end portion of the front member being disposed in the path of the swinging door when the container is seated on the shelf portion.

9. A security device according to claim 8, wherein a line of welding is applied to the front upright member in the angular corner between the flaring sides.

10. A security device according to claim 8, including an upright bar between the angular front member and the shelf portion.

11. A security device, according to claim 8, wherein the shelf portion includes upper and lower resilient members and an intermediate spacer therebetween holding said resilient members in opposed bowed relation.

12. A security device for limiting the opening movement of a swinging door of a container seated on a support, said device comprising back and front upright supports, and a shelf portion extending in bridging relation therebetween, said shelf portion being yieldable, the front support extending above the shelf portion to overlap the lower edge of the door, and an arm portion secured to the upper end portion of the front support and extending laterally therefrom for overlapping the edge of the door.

13. A security device for limiting the opening movement of a swinging door of a container having a portion seated on a support, said device comprising an upright front support and a platform extending reasonably therefrom in position beneath the container position, a yieldable support mounted on the platform beneath the container position, and an arm secured to the upright support and extending laterally therefrom for overlapping the edge of the door.

14. A method of maintaining the integrity of a container seated on a bed of a vehicle, said container having a swinging door, comprising: locating a security device on the bed, said security device having a shelf portion with an upright arm thereon, and pressurally engaging said security device by lowering the container toward the bed so that the container is seated on and partially supported by the security device and so that the upright arm is located in the path of swinging movement of the door, thereby preventing substantial opening movement of the door while the container is in said seated position.

15. A method of maintaining the integrity of a container according to claim 14, wherein the weight of the container on the shelf portion holds the arm rigidly in place in door retaining position.

* * * * *